United States Patent [19]

Braverman

[11] 4,322,930

[45] * Apr. 6, 1982

[54] METHOD FOR FILLING AND ASSEMBLING EXTENDED DISPENSING DEVICE

[76] Inventor: Milton Braverman, 640 Wynmill Pl., Philadelphia, Pa. 19115

[ * ] Notice: The portion of the term of this patent subsequent to Jul. 8, 1997, has been disclaimed.

[21] Appl. No.: 121,354

[22] Filed: Feb. 14, 1980

[51] Int. Cl.[3] ..... B65B 7/28; B65B 67/00

[52] U.S. Cl. ..... 53/471; 53/390; 53/543

[58] Field of Search ..... 206/820, 538, 539, 530, 206/534, 534.1, 459, 461, 484, 813; 53/543, 448, 471, 467, 390; 493/393, 379; 156/157, 277

[56] References Cited

U.S. PATENT DOCUMENTS

| | | | |
|---|---|---|---|
| 3,214,013 | 10/1965 | Diamant | 206/484 |
| 3,849,966 | 11/1974 | Preston et al. | 53/390 X |
| 3,924,748 | 12/1975 | Braverman | 206/538 X |
| 3,960,634 | 6/1976 | Kempster | 156/277 |
| 4,120,399 | 10/1978 | Clarke | 206/539 X |
| 4,122,651 | 10/1978 | Braverman | 53/390 |
| 4,211,329 | 7/1980 | Braverman | 206/534 |

*Primary Examiner*—James F. Coan

*Attorney, Agent, or Firm*—Caesar, Rivise, Bernstein & Cohen, Ltd.

[57] ABSTRACT

A method of joining an assembled multi-compartment medicinal dispensing device and an assembled multi-compartment extender to each other to provide an increased capacity device using an assembly fixture whose maximum capacity is no greater than that of the device. The fixture includes plural rows of openings, each opening being arranged for accommodating a respective compartment of the device during assembly thereof. The method comprises placing an assembled device on the fixture in a location wherein one row of openings is exposed, placing an assembled extender on the fixture with the compartments thereof being disposed within respective openings of said row, and with a portion of said extender disposed over a portion of said device and thereafter securing said portions to each other to join the device and the extender.

5 Claims, 7 Drawing Figures

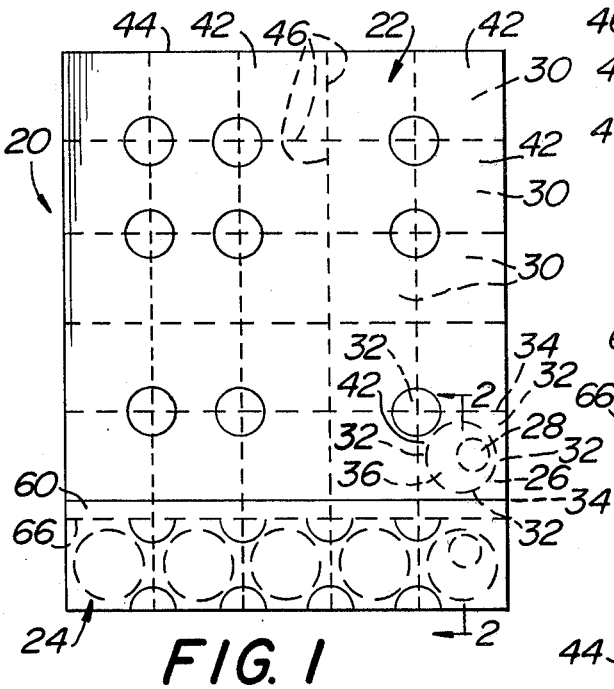
FIG. 1
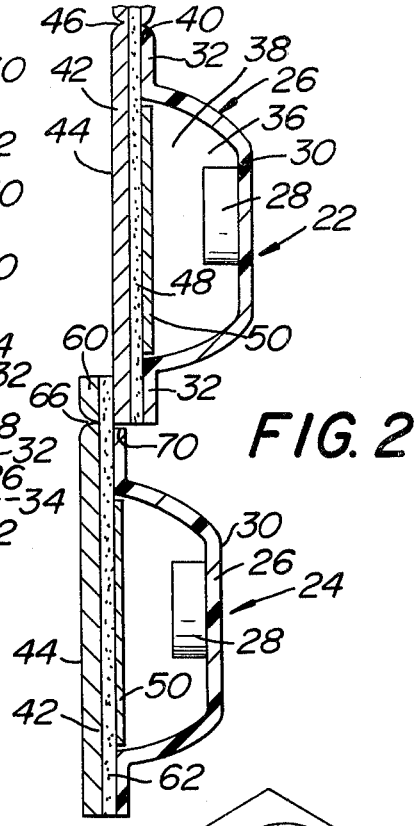
FIG. 2
FIG. 3
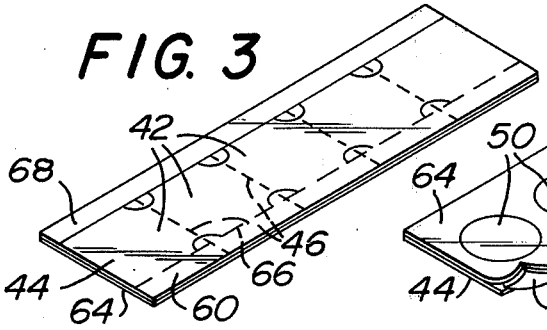
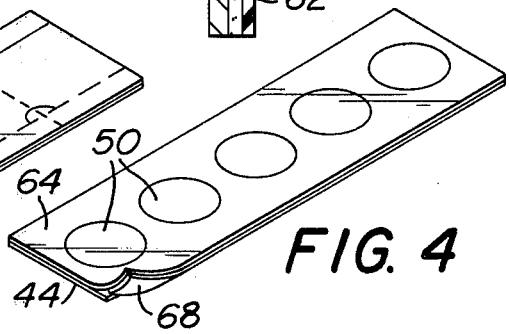
FIG. 4
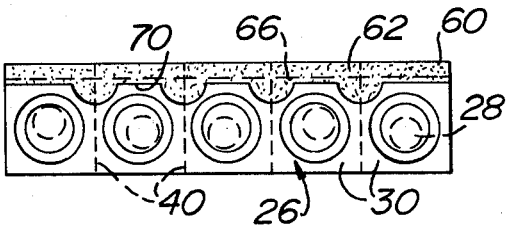
FIG. 5

METHOD FOR FILLING AND ASSEMBLING EXTENDED DISPENSING DEVICE

This invention relates generally to multi-compartment medicinal dispensing devices and, more particularly, to methods for filling extended capacity medicinal dispensing devices.

In my U.S. Pat. No. 3,780,856, whose disclosure is incorporated by reference herein, there is disclosed and claimed a multi-compartment medicinal dispensing device which is arranged for holding plural doses of medicine therein for subsequent dispensation. The device is arranged to be simply loaded and labeled by hospital or other personnel.

Unlike prior art devices, the device of said patent is arranged for manual unit dose use. To that end, that dispensing device comprises a plurality of individual medicine-holding units or compartments, each having flanges thereon. The flanges have corners and are detachably connected along predetermined weakened lines so that each flange may be separated from the remaining flanges to separate the units from one another. Each unit also includes a chamber with an outer opening depending from the flanges of the unit. The chamber is adapted to hold a dose of medicine. The cover sheet is used to seal the medicines within the compartments and is perforated along predetermined lines corresponding to the flange lines to form a plurality of individual closures therebetween. Each closure seals the opening of the chamber in the medicine unit disposed thereunder. At least one corner of a flange of each unit is cut away so that the existing corner of the individual closure overlying the cutaway area functions as a lift tab to facilitate the separation of the closure from the flange to which it is connected, to thereby provide access to the contents of the chamber disposed thereunder.

In one embodiment of the invention disclosed in said patent, the package has a capacity of twenty-five doses since there are five rows of five columns (i.e., five units per row) of compartments. A fixture base for filling the device is also disclosed. The fixture base has an array of five rows and five columns of openings which are adapted to receive respective chambers of the device's base to support the base during filling and securement of the cover sheet thereto.

While the device of U.S. Pat. No. 3,780,856 discloses a medicinal dispensing device which is suitable for the purposes for which it was intended, nevertheless, it is of somewhat limited utility in certain applications. For example, as is recognized, it is a common practice in the various types of nursing facilities, e.g., convalescent, skilled and extended, as well as in some hospitals, to prescribe and dispense medication on a thirty-day basis since most governmental agencies or insurance carriers follow a thirty-day reimbursement or payment schedule. Inasmuch as the multi-compartment medicinal dispensing devices disclosed in my aforementioned patent is based on five rows of five units, the capacity of such a device is insufficient for holding a thirty-day prescription.

In my co-pending patent application Ser. No. 033,923, filed on Apr. 27, 1979, there is disclosed and claimed an extender for increasing the capacity of a twenty-five unit dose package to a package having a greater capacity, e.g., a thirty dose package. To that end, the extender comprises a row of five article-holding units, each with flanges detachably connected along predetermined weakened lines so that each unit can be separated from the other units, a chamber for holding an article therein depending from the flanges and closure means in the form of plural closures. Each closure is co-extensive in size with a respective article-holding unit of the device and adapted to seal the opening thereof. The closures are formed by a cover sheet having an exterior surface and an interior surface having an adhesive thereon. The cover sheet includes plural weakened lines defining the closures and corresponding to the flange lines. The cover sheet also includes a tab portion extending beyond the flanges forming the row of units of the extender and a transversely extending weakened line contiguous with the flanges. Adhesive securement means is provided on the interior surface of the flange for securement to the exterior surface of the cover sheet of the medicinal dispensing device.

In order to fill an extended unit dose package, it was necessary to provide a fixture base having a greater number of openings than shown in my aforementioned patent. Accordingly, in my co-pending application Ser. No. 111,614, filed on Jan. 14, 1980, now U.S. Pat. No. 4,288,065, which is a division of my co-pending application Ser. No. 033,923 filed on Apr. 27, 1979 now U.S. Pat. No. 4,211,329, there is also disclosed and claimed a fixture base converter to convert a twenty-five opening fixture base, like that shown in my aforementioned patent, into a fixture having thirty openings to facilitate the filling and assembly of an extended capacity package, that is a package made up of a twenty-five unit dose device to which a five unit dose extender is secured.

Notwithstanding my invention of the converter, the need still exists for providing a method to enable the filling of an increased sized package utilizing a fixture base having a lesser number of openings than the number of units in the combined package. Accordingly, it is the general object of the instant invention to provide a method of filling and assembling extended multi-compartment medicinal dispensing packages which overcomes the disadvantages of the prior art.

It is a further object of this invention to provide a simplified method for filling and assembling multi-compartment medicinal dispensing devices using prior art fixture bases.

These and other objects of the instant invention are achieved by providing a method of filling and assembling the combination of a multi-compartment medicinal dispensing device and a multi-compartment extender utilizing a fixture having a first predetermined number of openings therein. The base of the device is in the form of a second predetermined number of article-holding units, each having flanges detachably connected along predetermined weakened lines and a chamber depending from each flange, with the units being arranged in a predetermined number of rows, each having a predetermined number of units, and a cover sheet secured over the chambers and including weakened lines corresponding to the weakened flange lines to enable each unit to be separated from the others. The extender comprises at least one row of a third predetermined number of article-holding units and a cover sheet. The extender is constructed like the units of the device and the cover sheet includes a transversely extending tab for securement to the cover sheet of the device. The method comprises disposing the device on the fixture so that the chambers of its base are located within respective openings in the fixture, disposing the cover sheet of the device over the base so that the weakened lines of each are coincident, applying pressure to secure the cover sheet to the base to form the device, disposing the assembled device in the fixture to expose a row of openings immediately adjacent to the device, disposing the base of an assembled extender in the fixture with the chambers of the base of the extender being located within respective openings within the exposed row of openings and with the tab of the cover sheet of the extender disposed over the cover sheet of the device and thereafter applying pressure to the tab to secure it to the cover sheet of the device.

Other objects and many of the attendant advantages of the instant invention will be readily appreciated as the same becomes better understood by reference to the following detailed description when considered in connection with the accompanying drawings, wherein:

FIG. 1 is a top elevational view of an assembled multi-compartment medicinal dispensing device and extender assembled in accordance with the method of the instant invention;

FIG. 2 is an enlarged sectional view taken along line 2—2 of FIG. 1;

FIG. 3 is a top perspective view of a component of the extender shown in FIG. 1 prior to asssembly;

FIG. 4 is a bottom perspective view of the component shown in FIG. 3;

FIG. 5 is a bottom elevational view of the extender of FIG. 1;

Figure 6:
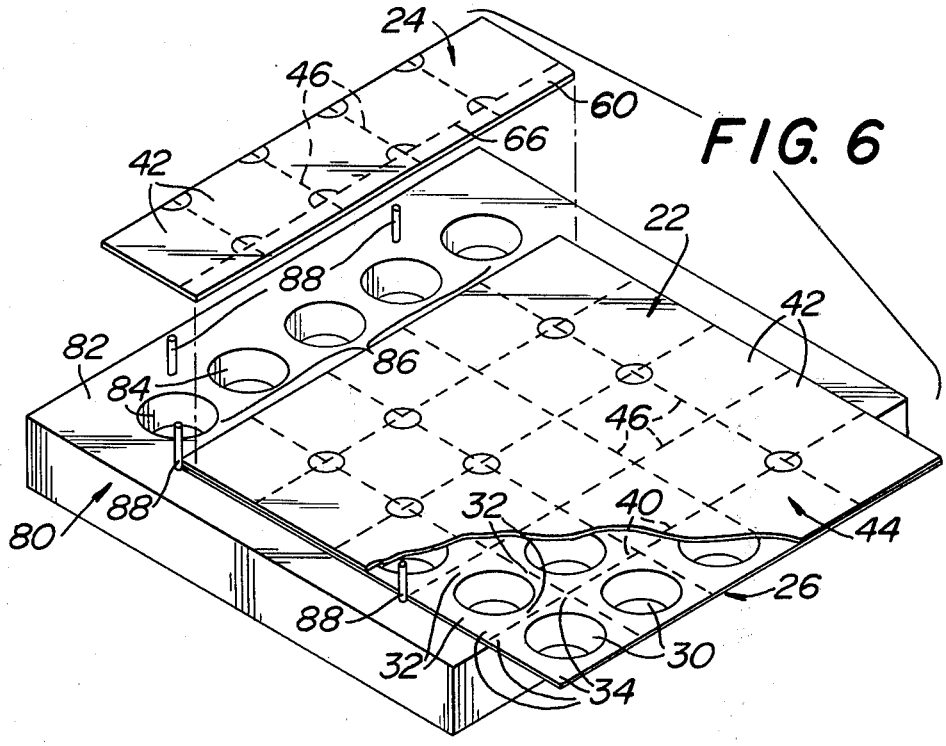
FIG. 6 is a perspective view showing a step in the method of the instant invention.

Referring now in greater detail to the various figures of the drawing, wherein like reference characters refer to like parts, there is shown at 20 in FIG. 1 an assembled multi-compartment medicinal dispensing device 22 like that disclosed and Claimed in my U.S. Pat. No. 3,780,856 and a multi-compartment medicinal dispensing device extender 24 like that disclosed and claimed in my aforenoted co-pending U.S. patent application Ser. No. 111,614 filed on Jan. 14, 1980, now U.S. Pat. No. 4,288,065.

Before describing the details of the method, a brief review of the construction of the dispensing device 22 and the extender 24 is in order. To that end, as can be seen in FIGS. 1–5, the medicinal dispensing device includes a multi-compartment base member 26 (FIG. 2) for holding a plurality of doses of medicine 28. The base 26 is formed of a plurality of article-holding units 30. Each unit is of generally rectangular shape and comprises four flanges 32 (FIG. 1) having corners 34 and a chamber 36 depending from the flanges. The chamber is bowl-shaped and includes an opening 38 through which the medicine is inserted for disposition within the chamber. The units 30 are detachably connected together by their flanges along intersecting weakened or perforated lines 40 (FIG. 2). Each unit has a flange having a cutaway corner (not shown).

The contents in the chamber of each unit is sealed therein by a respective closure 42 comprising a cover sheet 44 which has adhesive on its underside surface and is perforated along intersecting lines 46 corresponding to the flange lines 40. The intersecting lines 46 define the closures 42 therebetween, with each closure being co-extensive in size with an associated article-holding unit 30.

The cover sheet 44 is arranged to be secured to the base member 26 with the perforated lines 46 overlying and colinear with the flange lines 30 so that each closure member is secured in place to the associated flange to seal the opening in the chamber of the underlying unit.

The units 30 are adapted to be detached from each other along the colinear lines 40 and 46 to provide individual, sealed, article-holding units.

When it is desired to remove the contents of any unit 30, the closure 40 sealing that unit is peeled off at the cutaway flange corner to provide access to the interior of the chamber 36 and the medicine 28 disposed therein.

The closure basically comprises two distinct members, the heretofore described cover sheet 44 and a liner sheet (not shown). The liner sheet is co-extensive in size with the cover sheet 44 and protects the adhesive 48 on the cover sheet before the cover sheet is secured in place to the flanges. To that end, the liner sheet is temporarily secured to the cover sheet and adapted to be peeled off the cover sheet when the cover sheet is to be secured in place on the multi-compartment base. In order to enable the liner sheet to be readily removed from the cover sheet, the liner sheet is preferably formed of a relatively non-sticky material, such as a glassine-type paper.

The cover sheet is preferably formed of a strong and sturdy paper base. The exterior surface 48 of the cover sheet is coated to be receptive to pencil, ink, multilith spirit masters and photocopy offset so that writing or other indicia can be placed upon the exterior surface of the closures.

The liner sheet includes a plurality of circular portions 50 (FIG. 2) defined by plural circular die-cut lines. Each portion 50 is adapted to remain affixed to the adhesive coating 48 on the underside surface of the cover sheet after the liner sheet has been removed therefrom to provide a non-adhesive area on the inner surface of each of the closures of the cover sheet. Each non-adhesive circular portion is located over the opening 38 in the respective medicine holding unit 30 to preclude the medicine 28 disposed therein from adhering to the adhesive of the cover sheet when it is secured in place on the base.

Securement of the cover sheet to the base is as follows: After the liner sheet is removed from the cover sheet, the cover sheet is disposed over the device base with the weakened lines 46 coincident with flange lines 40. Pressure is applied to force the cover sheet down on the base so that the adhesive on the underside of the cover sheet contacts the flange to secure the closures on their respective units and seal the medicine doses therein.

As can be seen in FIG. 1, the plural article-holding units 30 of the dispensing device 22 are arranged in an array of five rows of five columns. Thus the device has a total capacity of twenty-five doses of medicine.

The extender 24 is constructed in a manner similar to that of the medicinal dispensing device 22, and thus in accordance with the teaching of my aforenoted patent, except that the extender 24 includes only a single row of five columns of article-holding units 30 and is formed by a base 26 and a cover sheet 44. In addition, the closure means for the extender includes a tab 60 for attaching the extender to the medicinal dispensing device 22. The underside of the cover sheet of the extender 24 includes an adhesive 62 thereon. A liner sheet 64, formed of a glassine-type material, is temporarily secured to the cover sheet 44. The cover sheet includes an edge 68 disposed opposite to the tab 60 to serve as a peel strip. The peel strip serves as the means for manually removing the liner sheet 64 from the cover sheet 44 as shown in FIG. 4 to leave the circular portions 54 on the underside of the cover sheet.

Once the liner sheet is peeled from the cover sheet and the medicine disposed in the extender base the cover sheet is disposed over the extender base with perforated lines of the cover sheet coincident with the lines of the base. The cover sheet is then brought into contact with the base so that the adhesive contact the flanges to secure the cover sheet in place and seal the medicines within the respective chambers of the extender like shown in FIG. 5.

As can be seen in FIGS. 2 and 5, the tab 60 of the extender extends beyond the top edge 70 of the extender's base 26. The underside of a portion of the tab 60 contiguous with the free edge thereof also includes adhesive 62 thereon. A weakened or perforated line 66 extends across the tab 60 parallel to but extending beyond the top edge 70 of the extender's base and serves as the means for detaching individual units 30 of the extender from one another and from the lowermost row of the device 22 after the extender has been secured thereto.

Figure 7:
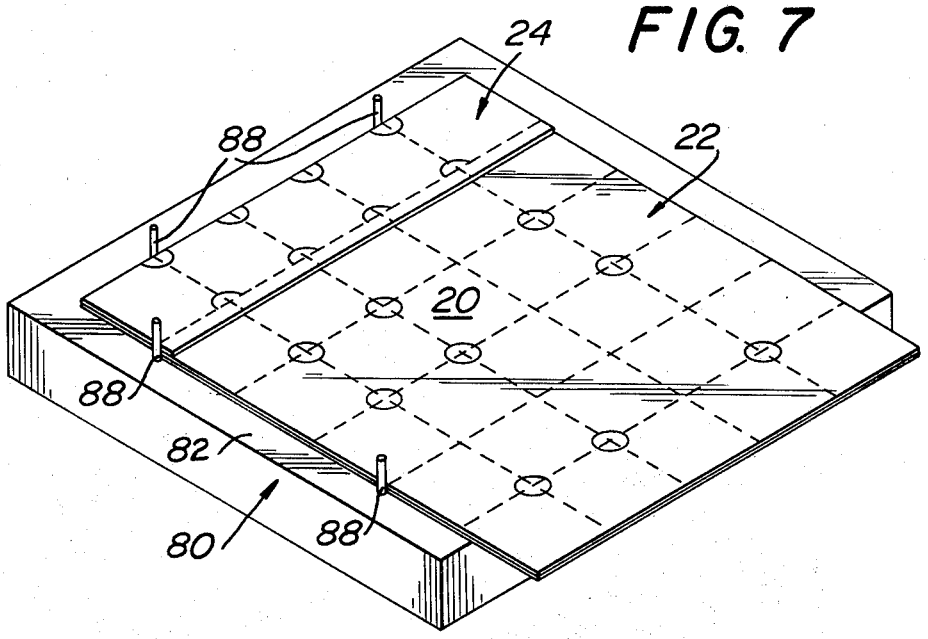
FIG. 7 is a perspective view, like that of FIG. 6, and showing a subsequent step in the method of the instant invention.

In FIGS. 6 and 7 there is shown an assembly fixture 80 constructed in accordance with the teachings of my aforenoted patent. The assembly fixture 80 basically comprises a planar base 82 have twenty-five openings 84 therein. Each of the openings is adapted to receive a respective one of the compartments 30 of the base of the medicinal dispensing device 22. Accordingly, the openings are arranged in an array of five rows of five columns, i.e., five rows of five openings per row. In FIG. 6 only the first row 86 can be seen. The base 82 also includes two pairs of spring loaded pins 88. One pair of pins 88 lies parallel to the top edge of the base 82 while the other pair lies parallel to the left side edge. The pins 88 are provided to guide the placement of the cover sheet on the multi-compartment medicinal dispensing device base 26 so that the perforations in the cover sheet coincide with the perforated flange lines in the base when the base is located within the array of openings 84. In addition, the pins facilitate the release of a pressure applying member (not shown) which is used to force the cover sheet into engagement with the multi-compartment base to seal the device as taught in my aforementioned patent.

The method of the instant invention is a follows: The base 26 of the multi-compartment medicinal dispensing device is disposed within the assembly fixture 80 so that each of the unit's chambers is located within a respective opening 84 in the assembly fixture. The individual doses of medicine or other medicaments 28 are then inserted within the desired chambers. The liner sheet is peeled off the cover sheet to expose the adhesive on the underside of the cover sheet. The cover sheet is then disposed over the multi-compartment base 26 by contacting the side guide pins 88 until the weakened or perforated lines of the cover sheet are coincident with the weakened or perforated flange lines 40. The pressure applying member (not shown) is then brought down on the top surface of the cover sheet to bring the cover sheet into intimate engagement with the flanges 32 of the multi-compartment base 26. This action seals the individual units of the multi-compartment medicinal dispensing device 30.

The extender 24 is assembled in a similar manner. To that end, the base 26 of the extender is disposed within the fixture 80 so that each of the chambers 30 is disposed within a respective one of the openings 84 in the top row of openings 86. The individual doses of medicine are then located in the respective chambers. The liner sheet 64 is peeled off the cover sheet 44 by grasping the peel strip 68 as shown in FIG. 4. This action exposes the adhesive on the underside of the cover sheet. The cover sheet is then disposed over the multi-compartment base 26 so that the tab 60 extends beyond the top edge 70 of the extender, with the perforated lines 66 immediately adjacent to the edge 70 as shown in FIG. 5. Care is taken to insure that the weakened or perforated lines 46 on the cover sheet are aligned with the corresponding flange lines 40 on the multi-compartment base 26. Pressure is then applied to the top surface of the cover sheet, via the use of the pressure applying member (not shown), to seal the cover sheet on the multi-compartment base and thus seal each of the individual units of the extender. The assembled extender is then ready for securement to the assembled device 22 to form the exended capacity multi-compartment medicinal dispensing device 20. Such assembly is as follows: The assembled device 20 is moved to the position shown in FIG. 6 wherein four rows of its units are located within the lowermost four rows of the fixture base 80 so as to leave the top row 86 of openings 84 of the fixture exposed. The assembled extender 24 is then positioned over the top row of openings 86 and inserted therein so that each of its chambers is located within a respective opening 84 in the row 86. This action causes the tab 60 of the extender to overly the top edge of the cover sheet of the device 22. The pressure applying member (not shown) is then brought into engagement over the interface of the tab 60 and the underlying portion of the cover sheet of the device 22. This action causes the adhesive 62 on the underside of the tab 60 to contact the underlying surface of the cover sheet of the device 22 to connect the extender 24 and the device 22 together.

The assembled device 22 is then ready for removal from the fixture base 80 for delivery to the patient.

It must be pointed out at this juncture that while the method of the instant invention has been shown and described with regard to the assembly of an extender having a single row of five units to a device having five rows of five units, the method can be used to secure an extender having any number of rows or units therein to a device having any number of rows of units providing the extender is formed of four or less units. Moreover, the method of the instant invention can be used to secure a second extender to an already extended capacity device 20. In this regard, all that is required is that once the first extender 24 has been secured to the device 22 as described heretofore, the combined device 20 is then moved from the position shown in FIG. 7 downward so that the first row 86 of opening of the fixture base 80 is exposed as shown in FIG. 6. A second extender can then be secured to the combination 20 in the same manner as described heretofore.

As will be appreciated from the foregoing, the method of the instant invention serves as a convenient and simple manner of increasing the capacity of medicinal dispensing devices by securing extenders thereto and utilizing a fixture base having a capacity smaller than the combined capacity of the extender and multi-compartment device.

Without further elaboration, the foregoing will so fully illustrate our invention that others may, by applying current or future knowledge, readily adapt the same for use under various conditions of service.

What is claimed as the invention is:

1. A method of assembling a multi-compartment medicinal dispensing device and a multi-compartment extender therefor utilizing a fixture having a first predetermined number of openings therein arranged in an array of plural rows, said device comprising a base in the form of a plurality of article-holding units each having flanges detachably connected along predetermined weakened lines and a chamber depending from each flange, said units being arranged in a second predetermined number of rows of plural units and a cover sheet secured over the chambers and including weakened lines corresponding to the weakened flange lines to enable each unit to be separated from the others, said extender comprising at least one row of a third predetermined number of article-holding units and a cover sheet, said extender being constructed like said device and wherein the cover sheet of said extender includes a transversely extending tab for securement to the cover sheet of said device, said method comprising: (a) locating an assembled device in said fixture to leave exposed in said fixture a row of openings immediately adjacent said device, (b) disposing the base of said extender on said fixture with the chambers thereof being located within the exposed row of openings in said fixture, and with the tab of the cover sheet of the extender disposed over an edge of the cover sheet of the assembled device, and (c) applying pressure to said tab to secure it to the cover sheet of the device.

2. The method of claim 1 wherein said device is assembled by: (d) disposing it on said fixture so that each of the chambers of its base is located within a respective opening in said fixture, (e) disposing the cover sheet of said device over said base so that the weakened lines of each are coincident, and (f) applying pressure to secure said cover sheet to said base.

3. The method of claim 2 wherein said extender is assembled by: (g) placing the extender base on the fixture so that its chambers are located within openings in said fixture, (h) disposing its cover sheet over said base so that the weakened lines of the cover sheet are disposed directly over the corresponding weakened lines of the base, and (i) applying pressure to secure the cover sheet to the base to form said extender.

4. The method of claim 3 wherein the fixture includes twenty-five openings being disposed in an array of five rows of five openings, wherein said device comprises twenty-five units in an array of five rows of five units and wherein said extender comprises five units disposed in a single row.

5. The method of claim 4 wherein said tab includes an underside surface and wherein an adhesive is disposed on the underside surface to facilitate the securement of the tab to the cover sheet of said device.

* * * * *